US012426765B2

(12) United States Patent
Jiang

(10) Patent No.: US 12,426,765 B2
(45) Date of Patent: Sep. 30, 2025

(54) MOP BUCKET WITH CLEAN AND DIRTY WATER SEPARATION

(71) Applicant: Jian Jiang, Lanxi (CN)

(72) Inventor: Jian Jiang, Lanxi (CN)

( * ) Notice: Subject to any disclaimer, the term of this patent is extended or adjusted under 35 U.S.C. 154(b) by 0 days.

(21) Appl. No.: 19/014,351

(22) Filed: Jan. 9, 2025

(65) Prior Publication Data

US 2025/0143531 A1 May 8, 2025

Related U.S. Application Data

(63) Continuation of application No. PCT/CN2024/127220, filed on Oct. 25, 2024.

(51) Int. Cl.

| | |
|---|---|
| ***A47L 13/58*** | (2006.01) |
| ***A47L 13/255*** | (2006.01) |
| ***A47L 13/50*** | (2006.01) |
| ***F04B 19/22*** | (2006.01) |

(52) U.S. Cl.
CPC ..... *A47L 13/50* (2013.01); *A47L 13/255* (2013.01); *F04B 19/22* (2013.01)

(58) Field of Classification Search
CPC ..... A47L 13/58; A47L 13/59
USPC ..... 15/260, 257.01
See application file for complete search history.

(56) References Cited

U.S. PATENT DOCUMENTS

| | | | | |
|---|---|---|---|---|
| 2020/0352407 | A1* | 11/2020 | Zhang | A47L 13/58 |
| 2021/0259505 | A1* | 8/2021 | Zhu | A47L 13/58 |

FOREIGN PATENT DOCUMENTS

| | | | | | |
|---|---|---|---|---|---|
| CN | 109645910 | A | | 4/2019 | |
| CN | 110856634 | A | * | 3/2020 | A47L 13/58 |
| CN | 216256974 | U | | 4/2022 | |
| CN | 114532928 | A | * | 5/2022 | A47L 13/58 |
| CN | 115137269 | A | | 10/2022 | |
| CN | 218220135 | U | | 1/2023 | |
| CN | 116669611 | A | | 8/2023 | |
| KR | 101024627 | B1 | | 3/2011 | |
| WO | WO-2019025645 | A1 | * | 2/2019 | A47L 13/58 |

OTHER PUBLICATIONS

Translation of CN-114532928-A (Year: 2022).*
Translation of CN-110856634-A (Year: 2020).*
Translation of WO-2019025645-A1 (Year: 2019).*

* cited by examiner

*Primary Examiner* — Tom Rodgers

(57) ABSTRACT

A mop bucket with clean and dirty water separation, comprising an outer bucket. A partition is arranged inside the outer bucket, and a clean water area and a dirty water area are respectively located on both sides of the partition in the outer bucket; a tub and a reciprocating pump driven by the tub capable of delivering water into the tub are arranged in the outer bucket, a valve assembly is arranged at a bottom of the tub to discharge water in the tub to the dirty water area, and the valve assembly has a movable water outlet end; only when the tub is located at an upper limit position and the water outlet end moves above the dirty water area, the valve assembly switches from the closed state to an open state. With the mop bucket, the mop can be conveniently operated for cleaning.

10 Claims, 15 Drawing Sheets

MOP BUCKET WITH CLEAN AND DIRTY WATER SEPARATION

CROSS-REFERENCE TO RELATED APPLICATIONS

This application is a continuation of International Patent Application No. PCT/CN2024/127220, filed on Oct. 25, 2024. The content of the aforementioned applications, including any intervening amendments thereto, are incorporated herein by reference.

TECHNICAL FIELD

The present disclosure belongs to the field of cleaning tools, and more particularly relates to a mop bucket for washing and spinning-drying mops.

BACKGROUND

The patent document numbered CN116669611A discloses a bucket assembly. The bucket assembly includes an inner bucket assembly and an outer bucket assembly. The inner bucket assembly includes a rinse barrel, a first reservoir, a fluid connection between the rinse barrel and the first reservoir, and at least one closure element disposed at the fluid connection and movable between an open position and a closed position. The inner bucket may include a filling hole and a plug. When the at least one closure element is in the open position, the first reservoir optionally seals in other positions.

The main feature of the solution is that the first reservoir is arranged to store clean water, and the closure element is opened before each cleaning of the mop so that the first reservoir injects a certain amount of clean water into the rinse barrel. In this way, the mop can be cleaned with clean water every time when it is needed to clean the mop, which is more conducive to cleaning the mop cleaner than the case where the same bucket of water is repeatedly used for cleaning the mop.

However, this solution still has the following disadvantages: firstly, the closure element is arranged on the first reservoir and needs to be opened before cleaning the mop each time; after the rinse barrel is filled with water, the closure element needs to be closed, that is, the user needs to bend or squat down to operate the closure element twice, which is not convenient for use. Secondly, when the mop is used to clean different positions, since there are usually differences in dirt levels at different positions, the dryness and wetness of the mop after mopping vary, and the amount of water injected into the rinse barrel each time is basically the same, which is not conducive to flexibly adjusting the amount of water required for cleaning the mop according to the dirt level and dryness and wetness of the mop.

SUMMARY

The technical problem to be solved by the present disclosure is as follows: in view of the shortcomings existing in the prior art, a mop bucket with clean and dirty water separation is provided, with which a mop can be cleaned with clean water every time when using the mop. It is convenient to fill water into the tub, users don't have to bend over, and the amount of water filled can be controlled by users according to needs.

In order to achieve the purpose of the present disclosure, the following technical solution is adopted: a mop bucket with clean and dirty water separation comprising a mop and a mop bucket for cleaning the mop;

the mop bucket comprises an outer bucket, wherein a partition is arranged inside the outer bucket, and a clean water area and a dirty water area are respectively located on both sides of the partition in the outer bucket;

a tub capable of moving up and down is arranged above the clean water area in the outer bucket, a reciprocating pump capable of pumping water from the clean water area to the tub is further arranged in the clean water area, the tub is connected with the reciprocating pump, and the tub can move downward under push of a mop and drive the reciprocating pump to operate;

a bottom of the tub is provided with a valve assembly capable of discharging water in the tub to the dirty water area, and the valve assembly has a movable water outlet end; and when the valve assembly is in a closed state, the water outlet end is away from the partition; only when the tub is located at an upper limit position and the water outlet end moves above the dirty water area, the valve assembly switches from the closed state to an open state.

As a preferred embodiment: a bottom of a side wall of the tub is provided with a drainage pipe extending towards the partition, and an outer wall of the tub is provided with a mounting bracket, and a valve plate is rotatably connected to the mounting bracket; a plug capable of closing an outer end of the drainage pipe is arranged on the valve plate, and a valve plate spring is connected between the valve plate and the mounting bracket to keep the plug and the outer end of the drainage pipe in a closed state;

a diversion trench for guiding water flowing out from the drainage pipe to the dirty water area is slidably installed on the mounting bracket or the drainage pipe, and an end of the diversion trench near the partition is the water outlet end;

a lever is further movably installed on the mounting bracket, and a lower end of the lever is in transmission connection with the diversion trench, so that the water outlet end of the diversion trench can move from above the clean water area to above the dirty water area; a diversion trench return spring is installed between the mounting bracket and the lever or the diversion trench, so that the water outlet end of the diversion trench can return from above the dirty water area to above the clean water area;

the diversion trench is provided with a pushing part capable of driving the valve plate to rotate, so that the plug and the outer end of the drainage pipe are switched from a closed state to an open state; only when the diversion trench moves under drive of the lever until the water outlet end exceeds the partition, the pushing part contacts with the valve plate and pushes the valve plate to rotate; and the valve assembly is composed of the mounting bracket, the valve plate, the diversion trench and the lever.

Compared with the prior art, the beneficial effects of the disclosure are as follows: since a reciprocating pump driven by a tub is arranged in the clean water area, when cleaning the mop, the reciprocating pump can be driven to operate and fill water into the tub by pressing down the mop. At this moment, the mop acts as a control lever of the reciprocating pump, so that there is no need to bend or squat during the process of filling water into the tub.

More importantly, after the mop is cleaned every time, dirty water with solid dirt may remain at the bottom of the tub. However, since the tub is located within the clean water area and can move up and down, it becomes a problem to discharge the dirty water in the tub into the dirty water area.

To this end, the present disclosure specifically designs a valve assembly to solve the above problems. Specifically, a diversion trench driven by a lever is arranged so that the dirty water flowing out of the drainage pipe can be discharged into the dirty water area on the other side of the partition through the diversion trench, and when no external force acts on the diversion trench, it is completely within the range of the clean water area and will not affect the up-and-down movement of the tub. In addition, since the pushing part on the diversion trench contacts with the valve plate and then pushes the valve plate to open only when the water outlet end of the diversion trench moves beyond the partition, it is difficult for the dirty water from the tub to flow into the clean water area. That is, the valve assembly can realize the movement of the diversion trench and the opening of the valve plate in turn by pulling the lever, so as to guide the dirty water in the tub into the dirty water area, so that no dirty water will be left in the tub when the mop is cleaned next time.

Figure 1:
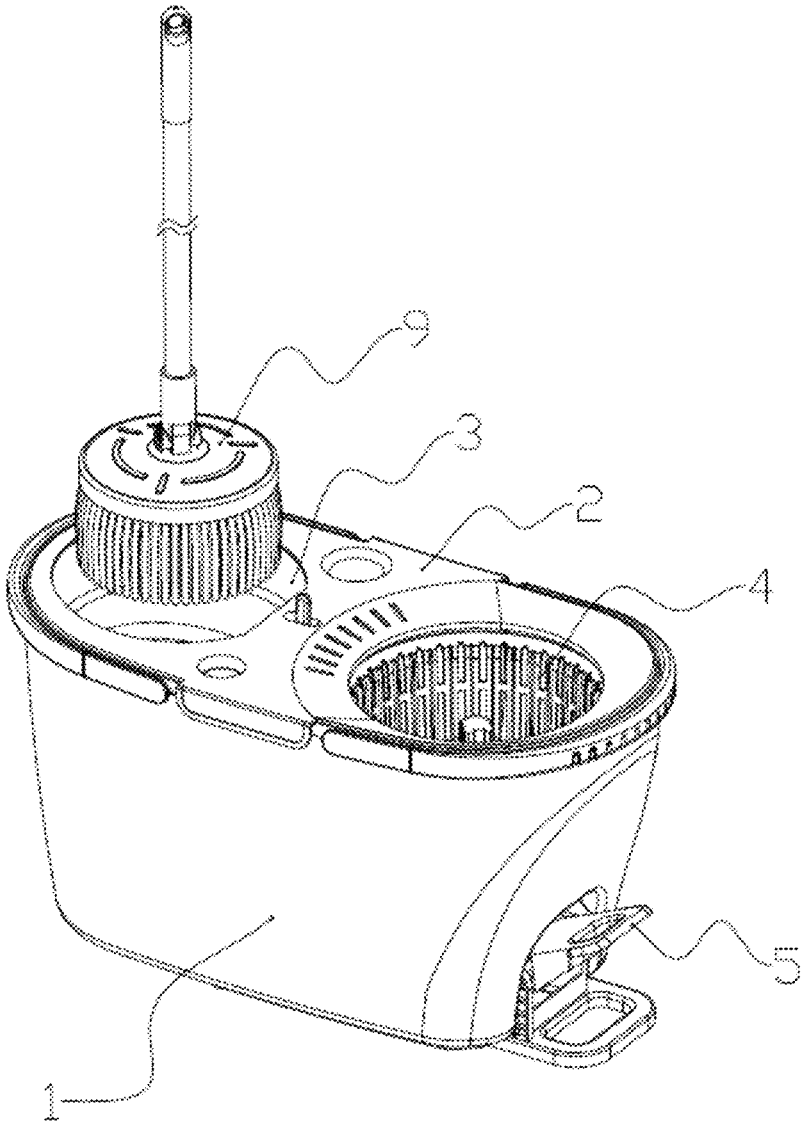
FIG. 1 is a schematic structural view of a cleaning tool according to the present disclosure.
Figure 2:
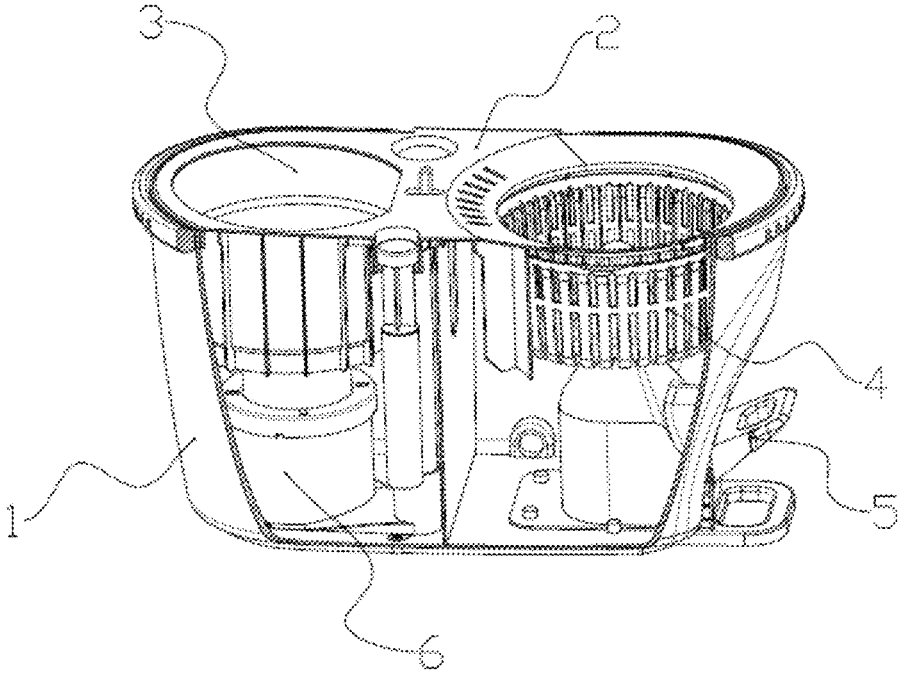
FIG. 2 is a schematic sectional view of a mop bucket according to the present disclosure.

1. outer bucket; 1*a*. clean water area; 1*b*. dirty water area; 10. handle; 11. partition; 111. drainage gap; 121. water inlet groove; 122. water outlet groove; 2. cover body; 2*a*. washing port; 2*b*. spin-drying port; 21. water filling port; 22. lever through hole; 23. guide wall; 231. limiting part; 24. indicator; 25. dirty water baffle; 3. tub; 301. drainage pipe; 302. confluence slope; 303. supporting bulge; 304. valve slot; 31. diversion trench; 310. Water outlet end; 311. sliding connection part; 312. pushing part; 32. lever; 321. rotation axis; 322. driving arm; 33. valve plate; 331. plug; 332. rotating shaft; 34. valve plate spring; 35. diversion trench return spring; 36. mounting rack; 361. horizontal guide rail; 362. valve plate mounting port; 363. lever mounting seat; 4. drying basket; 5. pedal driving mechanism; 51. base; 52. pedal; 521. drive gear; 531. first gear; 532. end face gear; 54. second gear; 55. transmission rod; 56. transmission plug; 6. reciprocating pump; 61. housing; 611. water inlet; 612. water outlet pipe joint; 613. water inlet baffle; 614. water outlet housing; 615. connecting outer bulge; 616. positioning post; 62. piston barrel; 63. sealing gasket; 64. water inlet valve plate; 65. return spring; 66. piston body; 661. piston rack; 67. limiting sleeve; 671. L-shaped groove; 672. elastic pressing part; 68. water outlet valve ball; 69. water outlet pipe; 690. limiting part; 691. water outlet joint; 692. track; 7. float; 71. sliding buckle; 9. mop.

DETAILED DESCRIPTION OF THE EMBODIMENTS

Referring to FIGS. 1-15, this embodiment is a mop bucket with clean and dirty water separation, comprising an outer bucket 1, wherein a partition 11 is arranged inside the outer bucket, a clean water area 1*a* and a dirty water area 1*b* are respectively located on both sides of the partition in the outer bucket, and the capacities of the clean water area 1*a* and the dirty water area 1*b* are equivalent. An upper part of the outer bucket is rotatably connected with two handles 10 arranged symmetrically.

A tub 3 capable of moving up and down is arranged above the clean water area in the outer bucket, a reciprocating pump 6 capable of pumping water from the clean water area to the tub is further arranged in the clean water area, the tub is connected with the reciprocating pump, and the tub can move downward under push of a mop 9 and drive the reciprocating pump to operate; a bottom of the tub is provided with a valve assembly capable of discharging water in the tub to the dirty water area, and the valve assembly has a movable water outlet end 310; when the valve assembly is in a closed state, the water outlet end is away from the partition; only when the tub is located at an upper limit position and the water outlet end moves above the dirty water area, the valve assembly switches from the closed state to an open state; and a spin-drying basket 4 for drying a mop is rotatably arranged above the dirty water area in the outer bucket.

In the above solution, when the mop is cleaned, the reciprocating pump can be driven to operate by pressing down the mop so as to fill water into the tub. At this moment, the mop acts as a control lever of the reciprocating pump, so that there is no need to bend or squat during the process of filling water into the tub.

In addition, the amount of water filled into the tub can be flexibly adjusted by controlling the number of times the reciprocating pump is pressed and the pressing amplitude. When a mop is slightly dirty, less water can be used to wash the mop so as to achieve the purpose of saving clean water; when the mop is seriously dirty, more water need to be used to wash the mop so as to achieve the purpose of thorough cleaning of the mop.

Figure 3:
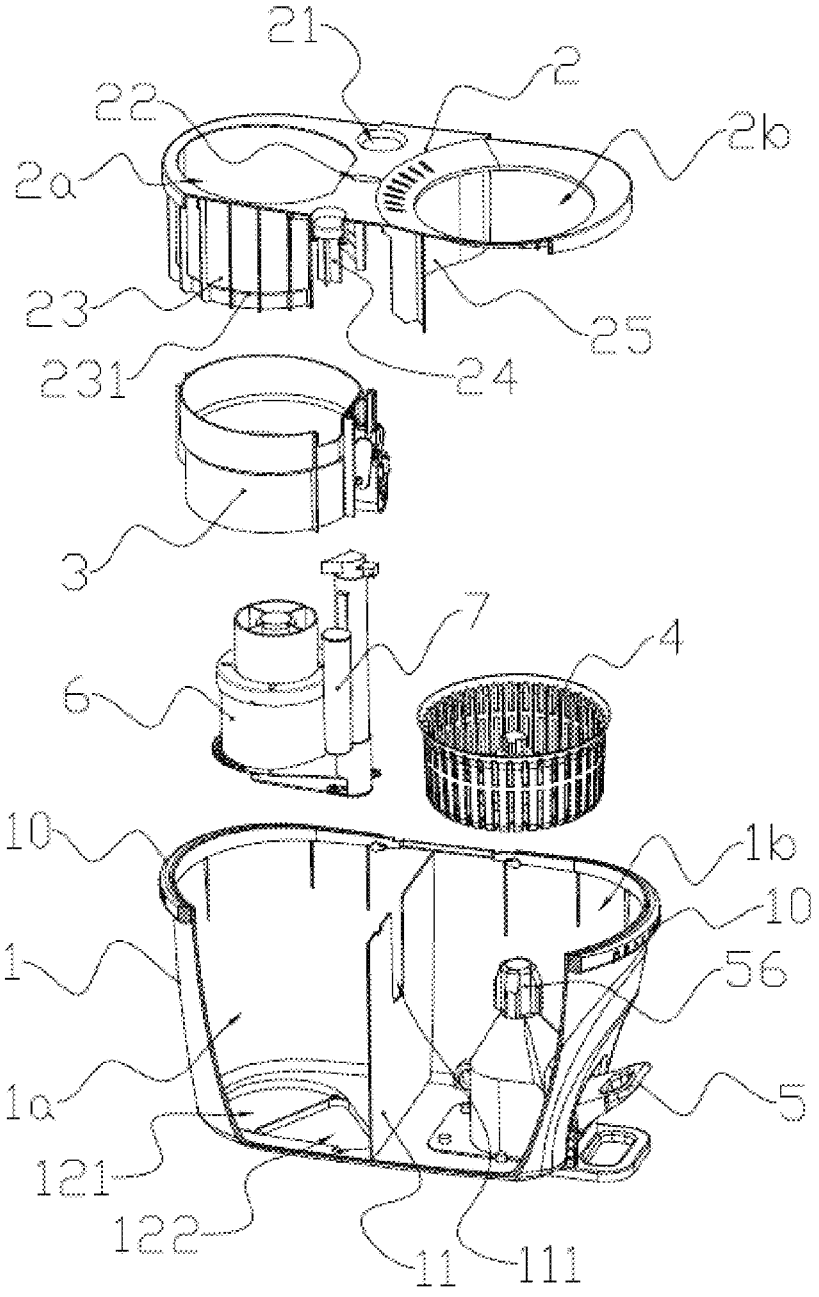
FIG. 3 is an exploded view of a mop bucket according to the present disclosure.
Figure 4:
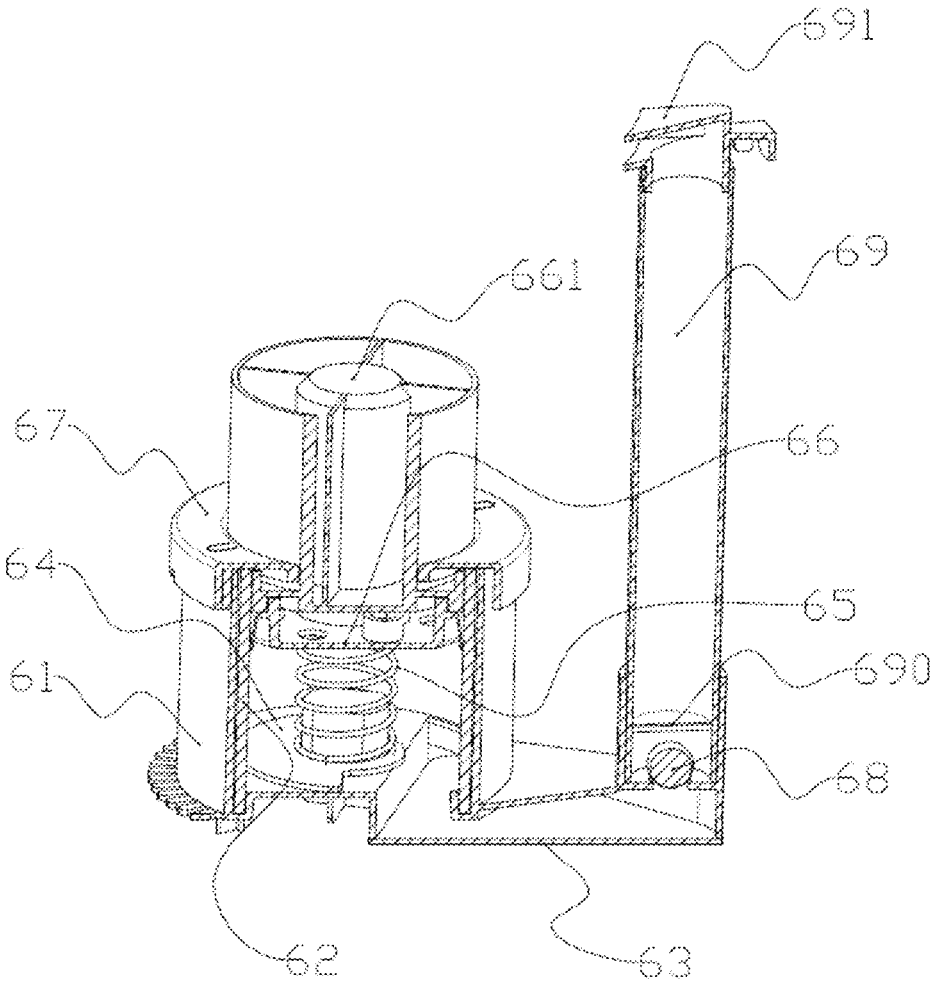
FIG. 4 is a schematic sectional view of a piston pump according to the present disclosure.
Figure 5:
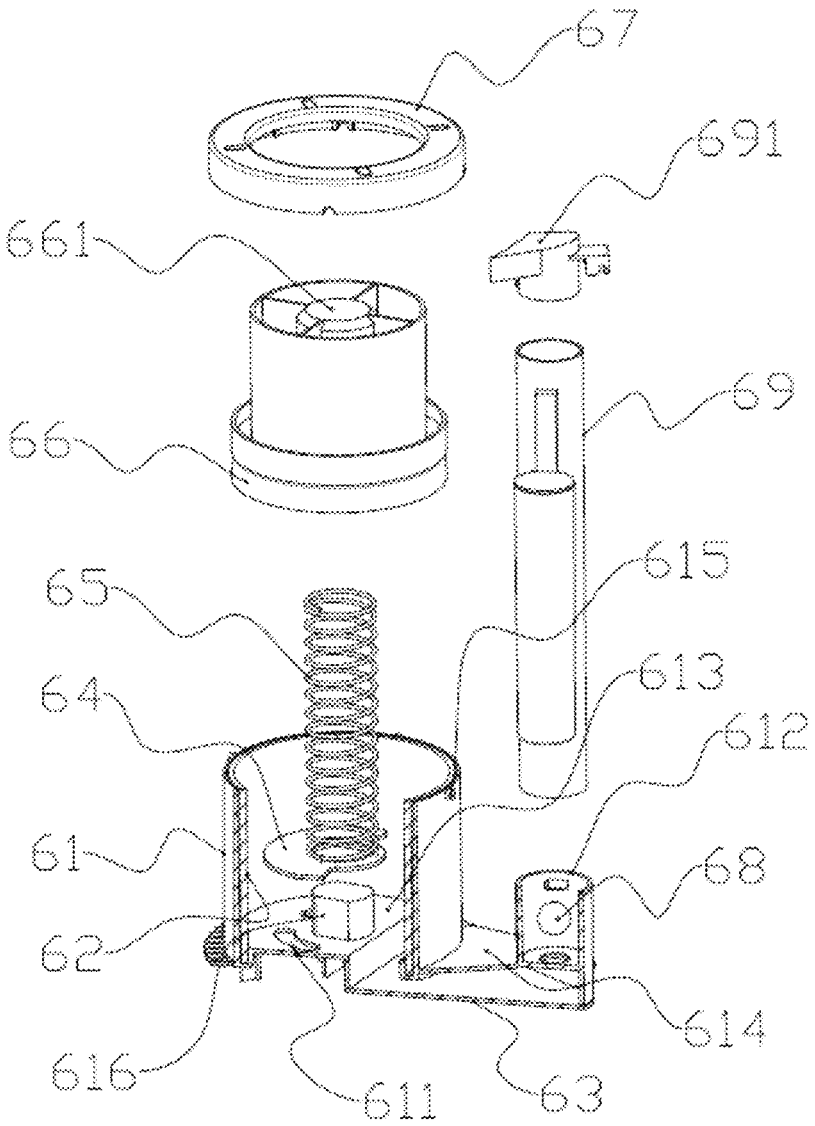
FIG. 5 is an exploded view of a piston pump according to the present disclosure.

A cover body 2 is detachably connected to an upper end of the outer bucket, a washing port 2*a* is provided on the cover body at a position corresponding to the tub, and a spin-drying port 2*b* is provided at a position corresponding to the spin-drying basket. A dirty water baffle 25 is provided at a position between the spin-drying basket and the partition at a lower end of the cover body to prevent dirty water thrown out by the spin-drying basket from splashing into the clean water area. A guide wall 23 which is in sliding connection with the tub is arranged at a lower end of the cover body located at a periphery of the washing port, and a limiting part 231 which prevents the tub from separating from the guide wall is arranged at a lower portion of the guide wall. As shown in FIG. 3, the tub is generally in the shape of a circular trough body, with a larger diameter at the upper part and a smaller diameter at the lower part. The upper part with a larger diameter is slidably connected to the guide wall, and a step part is formed at the transition position between the upper and lower parts. When the step part pushes against the limiting part 231, the tub is prevented from separating downwards from the cover body 2. The cover body 2 is detachably connected with the outer bucket through a buckle. When the cover body 2 is removed from the outer bucket, the tub is separated from the outer bucket 1 along with the cover body 2, which is convenient for cleaning the inside of the outer bucket 1.

A part of the cover body that is located within the clean water area is provided with a water filling port 21; an indicator 24 for indicating whether the clean water area is filled with water is connected in a sliding manner along a vertical direction in the part of the cover body that is located within the clean water area; a float 7 is arranged in the clean water area; when a water level in the clean water area reaches a set height, the float drives the indicator to move upward by buoyancy.

The reciprocating pump 6 is a piston pump, and the piston pump is fixedly installed in the clean water area and located below the tub; Referring to FIGS. 2-7, the piston pump comprises a housing 61, a piston barrel 62 vertically installed in the housing, a piston body 66 connected with the piston barrel in a sealed sliding manner, a piston rack 661 fixedly connected to an upper end of the piston body, a limiting sleeve 67 connected with an upper end of the housing for positioning an upper end of the piston barrel and restricting the piston body from separating from the piston barrel and being slidably connected with the piston rack, and a return spring 65 installed between the housing and the piston body or the piston rack; a water inlet baffle 613 is arranged at a bottom of the housing, and a water inlet 611 is arranged on the water inlet baffle; a water outlet housing 614 is integrally connected to an outer side of the bottom of the housing, a water outlet pipe joint 612 is arranged at an upper end of the water outlet housing, a water outlet pipe 69 is connected to an upper end of the water outlet pipe joint, and a water outlet joint 691 with an opening facing an inside of the tub is connected to an upper end of the water outlet pipe; The water outlet joint is relatively fixedly connected with the partition. A lower end of the tub abuts against or is detachably connected with an upper end of the piston rack.

Figure 8:
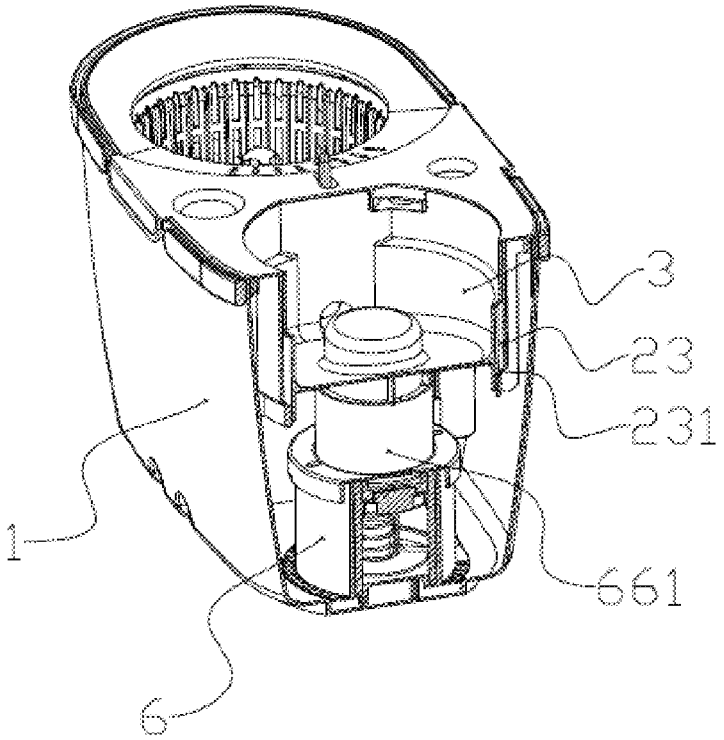
FIG. 8 is a schematic view of the tub according to the present disclosure in an initial position.
Figure 9:
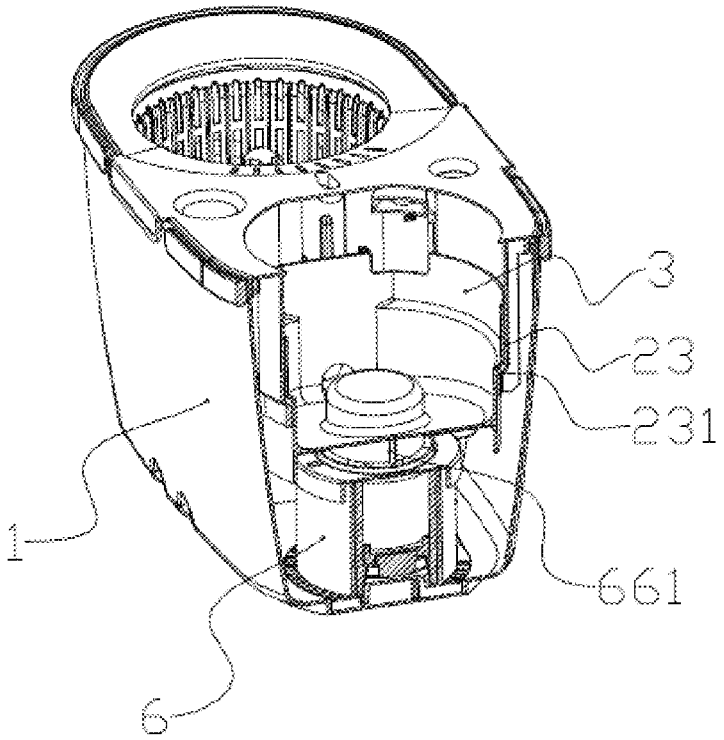
FIG. 9 is a schematic view when the tub of the present disclosure moves downward to an extreme position.
Figure 10:
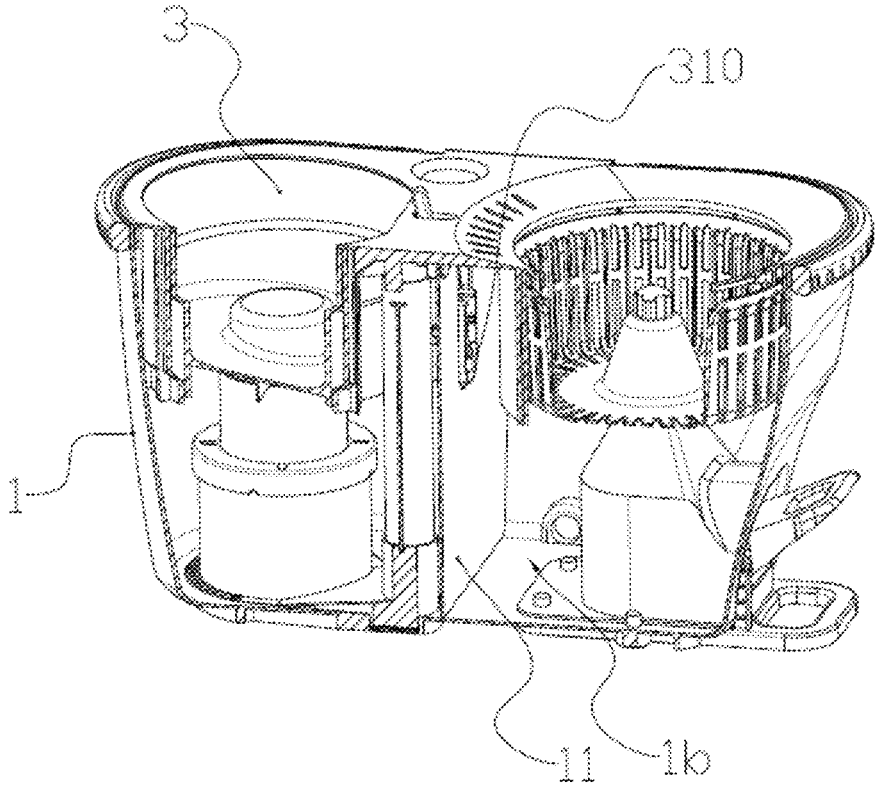
FIG. 10 is a schematic view of a water outlet end of the valve assembly according to the present disclosure as it moves over the dirty water area.
Figure 11:
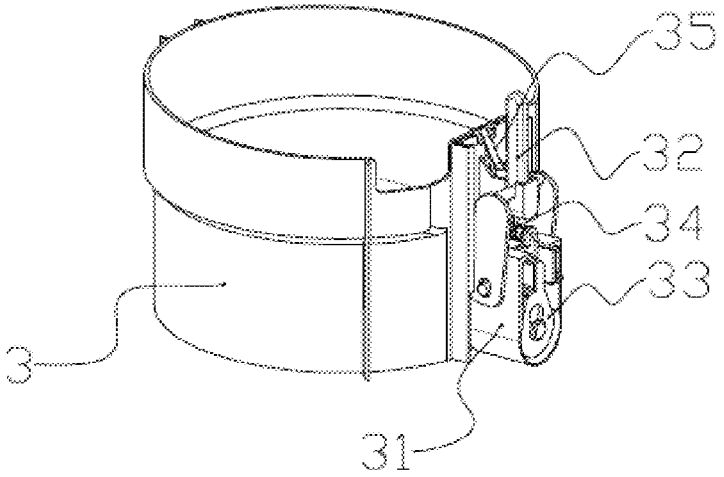
FIG. 11 is a schematic structural view of the valve assembly according to the present disclosure in a closed state.
Figure 12:
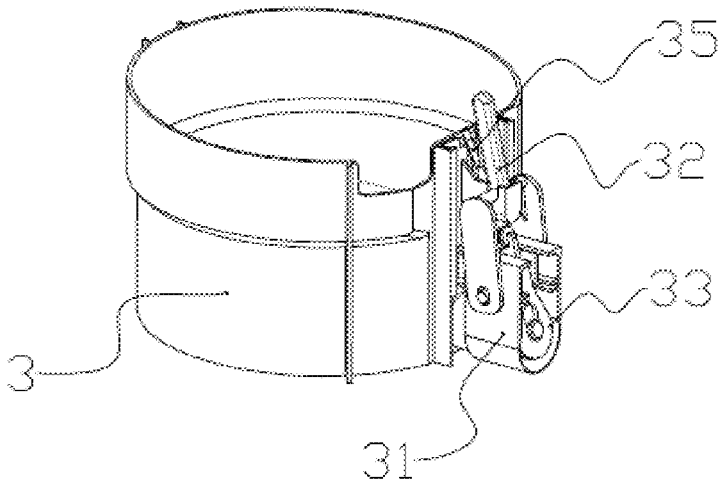
FIG. 12 is a schematic structural view of the valve assembly according to the present disclosure in an open state.

The diameter of the piston body is about 100 mm, and the effective height of the piston barrel is 40-70 mm. Therefore, each time when the piston rack is pressed to a limit position, the piston pump can roughly pump 300-550 ml of clean water into the tub, that is, only 1-3 times of pressing the piston pump are required for each cleaning of the mop. As shown in FIG. 8, since the piston body 66 is slidably connected with the piston barrel 62, and the piston rack 661 is slidably connected with the limiting sleeve, there is a certain distance between the two sliding connection positions in the up-and-down direction, which can ensure that an end face of the piston body with a larger diameter can always be kept horizontal, thus avoiding the situation where the piston body tilts to make it impossible to seal between the piston body and the piston barrel.

As shown in FIG. 3, a sunken water inlet groove 121 is arranged at a bottom of the clean water area corresponding to a position of the water inlet baffle, and a water inlet channel communicating with the clean water area and the piston barrel is formed between the water inlet groove and the water inlet baffle; further a sunken water outlet groove 122 is arranged at the bottom of the clean water area, and a water outlet channel communicating with the water outlet pipe joint and the piston barrel is formed between the water outlet groove and the water outlet housing; and a sealing gasket 63 is arranged between the bottom of the water outlet groove and a lower end of the water outlet housing. Referring to FIGS. 3 and 8, the water inlet groove is lower than an inner bottom of the clean water area, so that water in the clean water area can almost completely flow into the water inlet groove to be pumped into the piston pump.

an upper end of the water inlet baffle is provided with a water inlet valve plate 64, and the water inlet valve plate and the water inlet constitute a water inlet check valve that conducts unidirectionally from bottom to top; the water inlet valve plate is clamped between the upper end of the water inlet baffle and the return spring; a water outlet is arranged in the water outlet pipe joint, and a valve ball 68 is installed at an upper end of the water outlet in the water outlet pipe joint; the water outlet and the valve ball form a water outlet check valve that conducts unidirectionally from bottom to top; a limiting part 690 for limiting the moving range of the valve ball is arranged at an inner lower part of the water outlet pipe.

When clean water is injected into the clean water area, the water pressure will force the water inlet valve plate to open, namely, the water inlet check valve will be connected, and the air at the bottom of the piston barrel will be discharged through the water outlet check valve, the water outlet pipe and the water outlet joint in turn. If the piston body and the piston barrel are not perfectly sealed, clean water will completely fill the inside of the barrel underneath the piston body. If the piston body and the piston barrel are perfectly sealed, clean water can only enter at a point where the bottom of the piston barrel is approximately level with an inner top of the water outlet casing.

When the piston rack is pressed downwards, the water inlet check valve remains closed, and clean water in the pump cavity forces the water outlet check valve to be conducted. Clean water passes through the water outlet pipe and the water outlet joint in turn and is injected into the tub. After the external force pressing the piston rack is removed, the piston rack together with the piston body moves upwards under the action of a return spring. In this process, the water outlet check valve remains closed, the water inlet check valve opens, and the water in the clean water area flows into the pump cavity.

Figure 6:
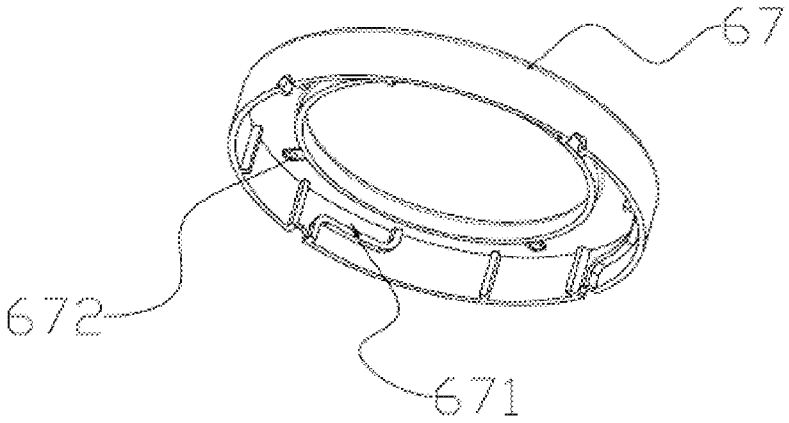
FIG. 6 is a schematic structural view of a limiting sleeve of the piston pump according to the present disclosure.

An outer wall of an upper part of the housing is provided with more than 2 connecting outer bulges 615 at equal angles, and an inner wall of the limiting sleeve is provided with L-shaped grooves 671 relatively fixedly connected to each connecting outer bulge; an inner top of the limiting sleeve is provided with a plurality of elastic pressing parts 672 at equal angles, and the elastic pressing parts are pressed against the upper end of the piston barrel. In actual production, the piston barrel is generally cut from extrusion-molded long plastic pipes. In order to reduce the requirements for its length accuracy, an elastic tight part is set so that the length of the piston barrel is within a certain error range, and the limiting sleeve can fix the piston barrel in the housing. As shown in FIG. 6, the elastic pressing part is a bulge protruding downwards, and the limiting sleeve 67 made of plastic material is provided with U-shaped through holes corresponding to the positions of each elastic pressing part, so that the position of the elastic pressing part has a certain degree of variability.

Figure 7:
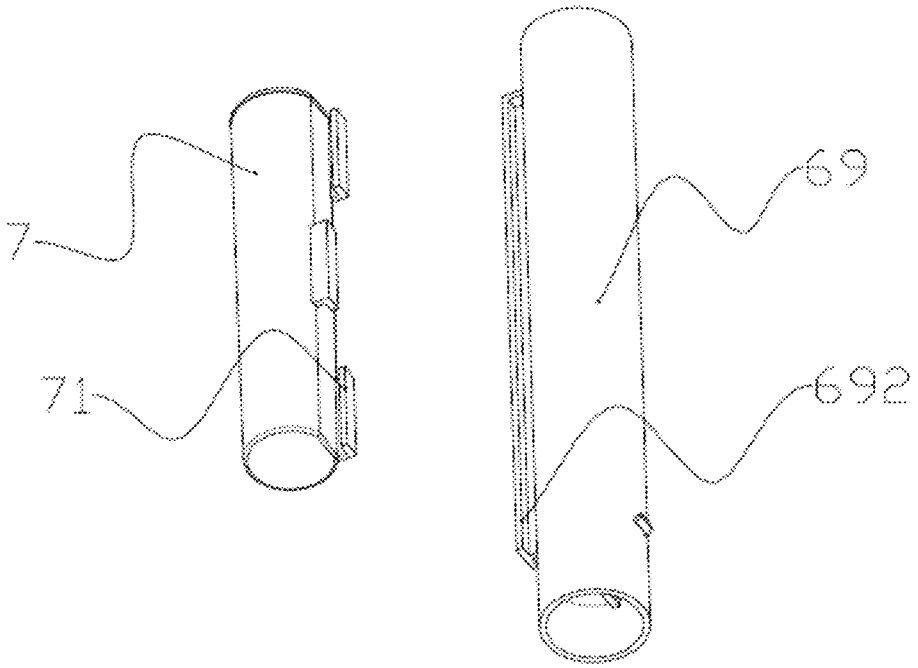
FIG. 7 is a schematic structural view showing the connection between the float and the water outlet pipe according to the present disclosure.

As shown in FIG. 7, an outer wall of the water outlet pipe is provided with a track 692 integrally injection molded with the water outlet pipe in a vertical direction, the section of the track is T-shaped, and a float 7 is slidably mounted on the track; a limiting part is arranged at an upper end of the track, and a sliding buckle 71 which is slidably connected to the track is arranged on a side wall of the float; after the float is connected with the track, a lower end of the water outlet pipe is then connected with the water outlet pipe joint, so that the float is confined between the water outlet pipe joint and the limiting part. The float is injection molded tubular, and at least its lower end is closed. For the convenience of manufacturing, there are at least 3 sliding buckles with an L-shaped cross section, one of which faces opposite to the other two, so that after the 3 sliding buckles 71 are sleeved on the track 692, they can maintain a state of sliding connection with the track.

The upper end of the water inlet baffle is provided with a positioning post 616, and the water inlet valve plate and the return spring are sleeved on the positioning post; a lower end of the piston rack is provided with a spring cavity for accommodating an upper part of the return spring. That is, when the piston rack moves downward to a limit position, an upper part of the positioning post is inserted into the spring cavity. That is, the positioning post and the spring cavity are not only used to locate the return spring, but also will not affect the movable distance of the piston body.

Specifically, referring to FIGS. 11-14, in order to drain the dirty water that may remain at the bottom of the tub after cleaning the mop into the dirty water area 1*b*, a drainage pipe 301 extending toward the partition is arranged at the bottom of the side wall of the tub, and the drainage pipe is horizontally arranged or slightly inclined downward towards one end of the partition. The outer wall of the tub is provided with a mounting bracket 36, and a valve plate 33 is rotatably connected to the mounting bracket. A soft plug 331 capable of closing the outer end of the drainage pipe is arranged on the valve plate, and the plug is made of soft rubber, silica gel or foamed plastic material. A valve plate spring 34 is connected between the valve plate and the mounting bracket. The valve plate spring keeps the plug and the outer end of the drainage pipe in a closed state. When opening the valve, it is necessary to overcome the elastic force of the valve plate spring and withdraw the external force on the valve plate, so that the valve plate is reset under the action of the valve plate spring to close the outer end of a water distribution pipe.

A diversion trench 31 for guiding water flowing out from the drainage pipe to the dirty water area is slidably installed on the mounting bracket or the drainage pipe, and an end of the diversion trench near the partition is the water outlet end 310. A lever 32 is further movably installed on the mounting bracket, and a lower end of the lever is in transmission connection with the diversion trench, so that the water outlet end of the diversion trench can move from above the clean water area to above the dirty water area; a diversion trench return spring 35 is installed between the mounting bracket and the lever or the diversion trench, so that the water outlet end of the diversion trench can return from above the dirty water area to above the clean water area. A drainage gap 111 is arranged on the partition at a position corresponding to the water outlet end, and the water outlet end of the diversion trench extends above the dirty water area through the drainage gap.

The diversion trench is provided with a pushing part capable of driving the valve plate to rotate, so that the plug and the outer end of the drainage pipe are switched from a closed state to an open state; only when the diversion trench moves under drive of the lever until the water outlet end exceeds the partition, the pushing part 312 contacts with the valve plate and pushes the valve plate to rotate; and the valve assembly is composed of the mounting bracket, the valve plate, the diversion trench and the lever.

The cover body is provided with a lever through hole 22 at the position corresponding to the lever for the upper end of the lever to pass out from bottom to top, that is, when the tub is in an initial position, the upper part of the lever is located above the cover body.

Further, in the above solution, a diversion trench 31 driven by a lever 32 is arranged so that the dirty water flowing out of the drainage pipe can be discharged into the dirty water area 1*b* on the other side of the partition through the diversion trench, and when no external force acts on the diversion trench, it is completely within the range of the clean water area 1*a* and will not affect the up-and-down movement of the tub. In addition, since the pushing part on the diversion trench contacts with the valve plate and then pushes the valve plate to open only when the water outlet end of the diversion trench moves beyond the partition, it is difficult for the dirty water from the tub to flow into the clean water area. That is, the valve assembly can realize the movement of the diversion trench and the opening of the valve plate in turn by pulling the lever, so as to guide the dirty water in the tub into the dirty water area, so that no dirty water will be left in the tub when the mop is cleaned next time.

Figure 13:
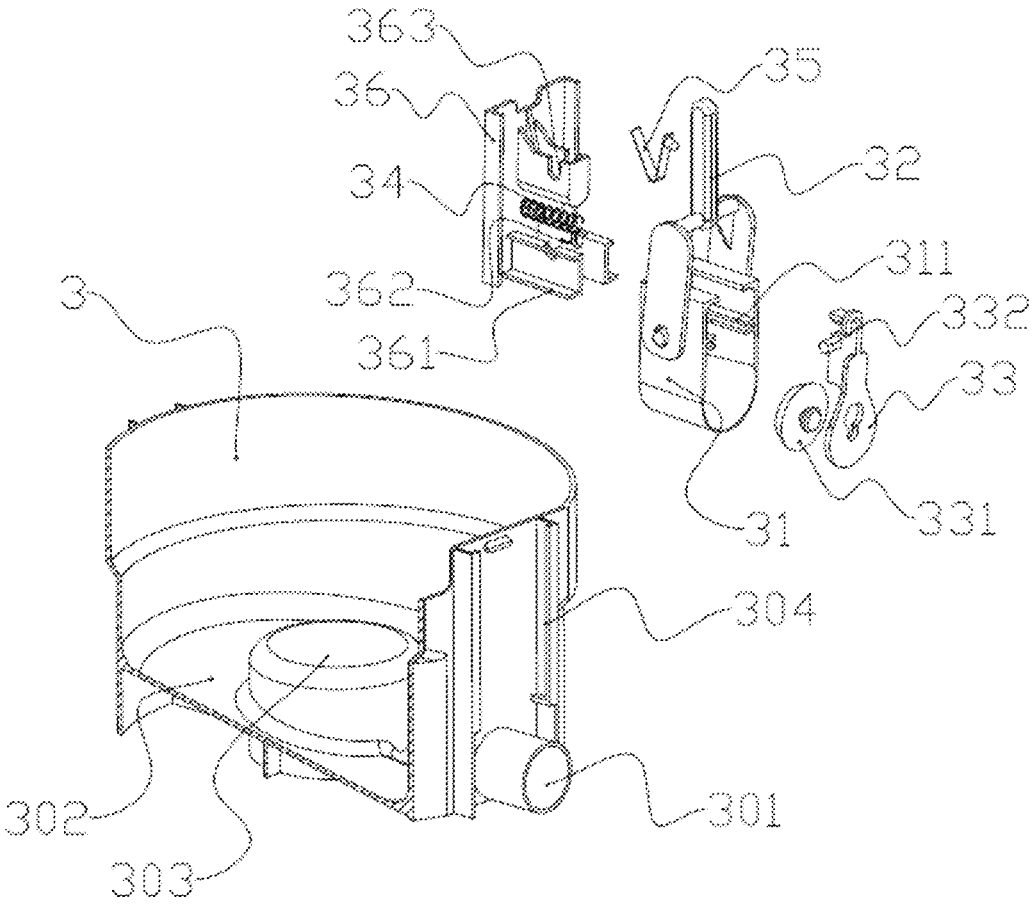
FIG. 13 is a schematic structural view of assembling the valve assembly and the tub according to the present disclosure.
Figure 14:
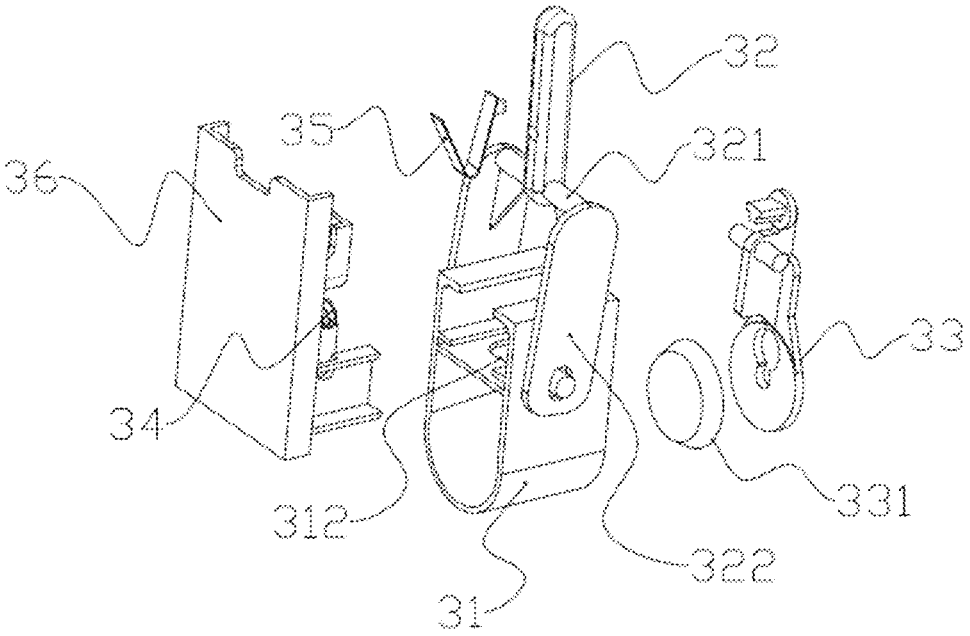
FIG. 14 is an exploded view of the valve assembly according to the present disclosure.

For the valve assembly, more specifically, as shown in FIG. 13 and FIG. 14, a horizontal guide rail 361 arranged in parallel with the drainage pipe is provided on the mounting bracket above the drainage pipe; the diversion trench is U-shaped as a whole, and inner walls at both sides of the diversion trench are provided with sliding connecting parts 311 which are slidably connected with the horizontal guide rail; an upper end of the horizontal guide rail is provided with a valve plate mounting port 362 rotatably connected to the valve plate, and both sides of the valve plate are provided with rotating shafts 332 rotatably connected to the valve plate mounting ports; after the diversion trench is connected to the horizontal guide rail, the rotating shafts are limited in the valve plate mounting port by the diversion trench. A lever mounting seat 363 is arranged on the mounting bracket above the horizontal guide rail, a rotation axis 321 rotatably connected with the lever mounting seat is arranged at the lower end of the lever, two driving arms 322 are arranged at both ends of the rotating shaft, raised heads are symmetrically arranged on outer walls on both sides of the diversion trench, and strip-shaped holes connected with corresponding side raised heads are arranged on the driving arms, so that when the lever rotates, the diversion trench can be driven to move along the direction of the drainage pipe.

The outer wall of the tub 3 is provided with a valve slot 304 for fixing the mounting bracket 36, the inner bottom of the tub is a confluence slope 302, and the drainage pipe is located at the lowest point of the confluence slope so that the dirty water in the tub can be completely discharged through the drainage pipe. A supporting bulge 303 extending upward is arranged at a middle position of the inner bottom of the tub.

The mop 9 comprises a mop head with a wiping cloth head and a mop rod connected to an upper end of the mop head;

when the mop is placed in a spin-drying basket to rotate and dry, the mop head together with the spin-drying basket rotates under drive of the mop rod and the mop rod is a pressing mop rod. The pressing mop rod is a commonly used accessory of the rotary mop in the prior art, and its specific structure can be referred to the rotary mop rod structure disclosed by patent document CN202198548U.

Figure 15:
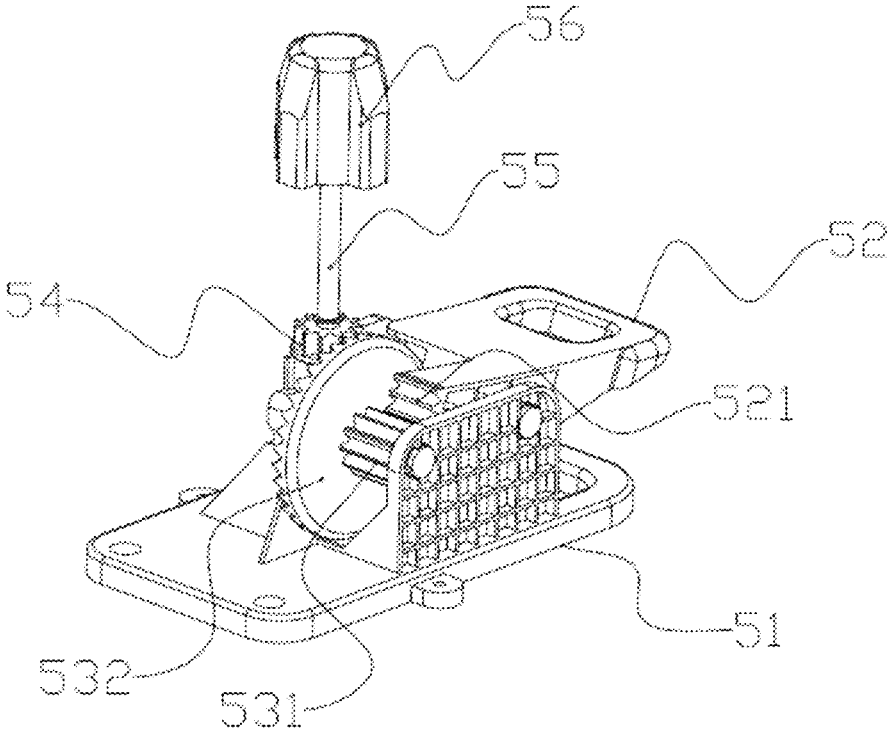
FIG. 15 is a schematic structural view of the pedal driving mechanism according to the present disclosure.

A pedal driving mechanism 5 for driving the spin-drying basket to rotate is arranged below the spin-drying basket outside the outer bucket. As shown in FIG. 15, the pedal driving mechanism comprises a base 51, a pedal 52 rotatably connected to the base, a first gear 531 rotatably connected to the base and in transmission connection with the pedal, a face gear 532 coaxially fixedly connected to the first gear, a second gear 54 meshed with and in transmission connection with the face gear, and a transmission rod 55 rotatably connected to the base and in transmission connection with the second gear through a one-way needle bearing, and a transmission plug 56 fixedly connected to an upper end of the transmission rod. The base is fixedly connected with the bottom of the outer bucket, the transmission rod passes through the outer bucket, and the transmission plug is detachably plugged into the spin-drying basket above the dirty water area. The detachable design of the spin-drying basket is convenient for dismantling the spin-drying basket to clean the inside of the outer bucket more thoroughly. An end of the pedal is provided with driving teeth 521 meshingly connected to the first gear for transmission, and a return torsion spring is installed between the pedal and the base.

When in use, water is injected into the clean water area 1*a* of the outer bucket 1 through a water filling port until an upward movement of the indicator is seen, which indicates that the water level in the clean water area reaches a set value and the water filling is completed.

Then put the mop head of the mop into the tub, press down the mop rod to drive the tub together with the piston rack and piston body to move downwards. Press down the mop rod 1-3 times according to the dryness and dirt degree of the mop head, so that the piston pump can inject an appropriate amount of clean water for cleaning the mop into the tub. After cleaning the mop head, move the mop head to the spin-drying basket for spin-drying.

If dirty water remains in the tub, it is only necessary to move the lever 32 to drive the diversion trench to move to the water outlet end 310 above the dirty water area and open the valve plate 33 so that the dirty water remaining in the tub can be discharged into the dirty water area. If there is no residual dirty water in the tub, or the user thinks that the residual dirty water is very little and has no significant effect on re-cleaning the mop head, it may not be necessary to operate the lever.

What is claimed is:

1. A mop bucket with clean and dirty water separation, comprising a mop (9) and the mop bucket for cleaning the mop; the mop bucket comprises an outer bucket (1), wherein a partition (11) is arranged inside the outer bucket, and a clean water area (la) and a dirty water area (1*b*) are respectively located on both sides of the partition in the outer bucket;

a tub (3) capable of moving up and down is arranged above the clean water area in the outer bucket, a reciprocating pump (6) capable of pumping water from the clean water area to the tub is further arranged in the clean water area, the tub is connected with the reciprocating pump, and the tub can move downward under push of the mop and drive the reciprocating pump to operate;

a bottom of the tub is provided with a valve assembly capable of discharging water in the tub to the dirty water area, and the valve assembly has a movable water outlet end (310);

only when the tub is located at an upper limit position and the water outlet end moves above the dirty water area, the valve assembly switches from a closed state to an open state;

a bottom of a side wall of the tub is provided with a drainage pipe (301) extending towards the partition, and an outer wall of the tub is provided with a mounting bracket (36), and a valve plate (33) is rotatably connected to the mounting bracket;

a diversion trench (31) for guiding water flowing out from the drainage pipe to the dirty water area is slidably installed on the mounting bracket or the drainage pipe, and an end of the diversion trench near the partition is the water outlet end (310);

a lever (32) is further movably installed on the mounting bracket, and a lower end of the lever is in transmission connection with the diversion trench, so that the water outlet end of the diversion trench can move from above the clean water area to above the dirty water area;

the diversion trench is provided with a pushing part capable of driving the valve plate to rotate, only when the diversion trench moves under drive of the lever until the water outlet end exceeds the partition, the pushing part contacts with the valve plate and pushes the valve plate to rotate; and the valve assembly is composed of the mounting bracket, the valve plate, the diversion trench and the lever.

2. The mop bucket with clean and dirty water separation according to claim 1, wherein a horizontal guide rail (361) arranged in parallel with the drainage pipe is provided on the mounting bracket above the drainage pipe; the diversion trench is U-shaped as a whole, and inner walls at both sides of the diversion trench are provided with sliding connecting parts (311) which are slidably connected with the horizontal guide rail;

an upper end of the horizontal guide rail is provided with a valve plate mounting port (362) rotatably connected to the valve plate, and both sides of the valve plate are provided with rotating shafts (332) rotatably connected to the valve plate mounting ports; after the diversion trench is connected to the horizontal guide rail, the rotating shafts are limited in the valve plate mounting port by the diversion trench; and a lever mounting seat (363) is arranged on the mounting bracket above the horizontal guide rail, a rotation axis (321) rotatably connected with the lever mounting seat is arranged at the lower end of the lever, two driving arms are arranged at both ends of the rotation axis, raised heads are symmetrically arranged on outer walls on both sides of the diversion trench, and strip-shaped holes connected with corresponding side raised heads are arranged on the driving arms, so that when the lever rotates, the diversion trench can be driven to move along the direction of the drainage pipe.

3. The mop bucket with clean and dirty water separation according to claim 1, wherein a cover body (2) is detachably connected to an upper end of the outer bucket, a washing port (2*a*) is provided on the cover body at a position corresponding to the tub, and a spin-drying port (2*b*) is provided at a position corresponding to the spin-drying basket; a guide wall (23) which is in sliding connection with the tub is arranged at a lower end of the cover body located at a periphery of the washing port, and a limiting part (231) which prevents the tub from separating from the guide wall is arranged at a lower portion of the guide wall.

4. The mop bucket with clean and dirty water separation according to claim 3, wherein a part of the cover body that is located within the clean water area is provided with a water filling port (21); an indicator (24) for indicating whether the clean water area is filled with water is connected in a sliding manner along a vertical direction in the part of the cover body that is located within the clean water area; a float (7) is arranged in the clean water area; when a water level in the clean water area reaches a set height, the float drives the indicator to move upward by buoyancy.

5. The mop bucket with clean and dirty water separation according to claim 1, wherein the reciprocating pump is a piston pump, and the piston pump is fixedly installed in the clean water area and located below the tub;

the piston pump comprises a housing (61), a piston barrel (62) vertically installed in the housing, a piston body (66) connected with the piston barrel in a sealed sliding manner, a piston rack (661) fixedly connected to an upper end of the piston body, a limiting sleeve (67) connected with an upper end of the housing for positioning an upper end of the piston barrel and restricting the piston body from separating from the piston barrel and being slidably connected with the piston rack, and a return spring (65) installed between the housing and the piston body or the piston rack;

a water inlet baffle (613) is arranged at a bottom of the housing, and a water inlet (611) is arranged on the water inlet baffle; a water outlet housing (614) is integrally connected to an outer side of the bottom of the housing, a water outlet pipe joint (612) is arranged at an upper end of the water outlet housing, a water outlet pipe (69) is connected to an upper end of the water outlet pipe joint, and a water outlet joint (691) with an opening facing an inside of the tub is connected to an upper end of the water outlet pipe;

a sunken water inlet groove (121) is arranged at a bottom of the clean water area corresponding to a position of the water inlet baffle, and a water inlet channel communicating with the clean water area and the piston barrel is formed between the water inlet groove and the water inlet baffle; further a sunken water outlet groove (122) is arranged at the bottom of the clean water area, and a water outlet channel communicating with the water outlet pipe joint and the piston barrel is formed between the water outlet groove and the water outlet housing; and an upper end of the water inlet baffle is provided with a water inlet valve plate (64), and the water inlet valve plate and the water inlet constitute a water inlet check valve that conducts unidirectionally from bottom to top; the water inlet valve plate is clamped between the upper end of the water inlet baffle and the return spring; a water outlet is arranged in the water outlet pipe joint, and a valve ball (68) is installed at an upper end of the water outlet in the water outlet pipe joint; the water outlet and the valve ball form a water outlet check valve that conducts unidirectionally from bottom to top; a limiting part (690) for limiting the moving range of the valve ball is arranged at an inner lower part of the water outlet pipe.

6. The mop bucket with clean and dirty water separation according to claim 5, wherein an outer wall of an upper part of the housing is provided with more than 2 connecting outer bulges (615) at equal angles, and an inner wall of the limiting sleeve is provided with L-shaped grooves (671) relatively fixedly connected to each connecting outer bulge; an inner top of the limiting sleeve is provided with a plurality of elastic pressing parts (672) at equal angles, and the elastic pressing parts are pressed against the upper end of the piston barrel.

7. The mop bucket with clean and dirty water separation according to claim 5, wherein an outer wall of the water outlet pipe is provided with a track (692) integrally injection molded with the water outlet pipe in a vertical direction, and a float (7) is slidably mounted on the track; a limiting part is arranged at an upper end of the track, and a sliding buckle (71) which is slidably connected to the track is arranged on a side wall of the float; after the float is connected with the track, a lower end of the water outlet pipe is then connected with the water outlet pipe joint, so that the float is confined between the water outlet pipe joint and the limiting part.

8. The mop bucket with clean and dirty water separation according to claim 5, wherein the upper end of the water inlet baffle is provided with a positioning post (616), and the water inlet valve plate and the return spring are sleeved on the positioning post; a lower end of the piston rack is provided with a spring cavity for accommodating an upper part of the return spring.

9. The mop bucket with clean and dirty water separation according to claim 1, wherein the mop (9) comprises a mop head with a wiping cloth head and a mop rod connected to an upper end of the mop head;

when the mop is placed in a spin-drying basket to rotate and dry, the mop head together with the spin-drying basket rotates under drive of the mop rod and the mop rod is a pressing mop rod; or a pedal driving mechanism (5) for driving the spin-drying basket to rotate is arranged below the spin-drying basket outside the outer bucket.

10. The mop bucket with clean and dirty water separation according to claim 9, wherein the pedal driving mechanism comprises a base (51), a pedal (52) rotatably connected to the base, a first gear (531) rotatably connected to the base and in transmission connection with the pedal, a face gear (532) coaxially fixedly connected to the first gear, a second gear (54) meshed with and in transmission connection with the face gear, and a transmission rod (55) rotatably connected to the base and in transmission connection with the second gear through a one-way needle bearing, and a transmission plug (56) fixedly connected to an upper end of the transmission rod;

the base is fixedly connected with the bottom of the outer bucket, the transmission rod passes through the outer bucket, and the transmission plug is detachably plugged into the spin-drying basket above the dirty water area; and an end of the pedal is provided with driving teeth (521) meshingly connected to the first gear for transmission, and a return torsion spring is installed between the pedal and the base.

* * * * *